US007530206B2

(12) United States Patent
Getz

(10) Patent No.: US 7,530,206 B2
(45) Date of Patent: May 12, 2009

(54) SEMI-PERMANENT, IN-POOL SURFACE CONSTRUCTION

(76) Inventor: Jeffrey L. Getz, 301 W. El Caminito Dr., Phoenix, AZ (US) 85021

( * ) Notice: Subject to any disclaimer, the term of this patent is extended or adjusted under 35 U.S.C. 154(b) by 110 days.

(21) Appl. No.: 11/777,268

(22) Filed: Jul. 12, 2007

(65) Prior Publication Data

US 2009/0013458 A1 Jan. 15, 2009

(51) Int. Cl.
*E04G 23/00* (2006.01)

(52) U.S. Cl. ..... 52/745.2; 52/169.7; 52/483.1; 52/480

(58) Field of Classification Search ..... 52/169.7, 52/102, 289, 483.1, 702, 745.06, 745.2, 480
See application file for complete search history.

(56) References Cited

U.S. PATENT DOCUMENTS 3,633,950 A * 1/1972 Gilb ..... 403/384
3,899,152 A * 8/1975 Avery ..... 249/18
4,135,259 A * 1/1979 Scardenzan ..... 4/498
4,158,940 A * 6/1979 Lancelot et al. ..... 52/702
4,348,002 A * 9/1982 Eyden ..... 249/19
4,584,802 A * 4/1986 Casselman et al. ..... 52/169.7
4,622,792 A * 11/1986 Betts ..... 52/263
4,831,672 A * 5/1989 Niimura ..... 4/495
4,937,896 A * 7/1990 Niimura ..... 4/495
5,074,084 A * 12/1991 Kriss ..... 52/73
5,271,483 A * 12/1993 Hong ..... 187/255
5,606,831 A * 3/1997 Tippmann et al. ..... 52/169.7
5,617,689 A * 4/1997 Beane ..... 52/489.1
5,657,589 A * 8/1997 De Bood ..... 52/169.7
5,678,253 A * 10/1997 Baker ..... 4/495
5,701,706 A * 12/1997 Kreysler et al. ..... 52/169.6
5,921,030 A * 7/1999 Ducotey et al. ..... 52/3
6,301,855 B1 * 10/2001 Aerni ..... 52/702
7,412,733 B2 * 8/2008 Dorsch ..... 4/498
2004/0050009 A1 * 3/2004 Fuhr ..... 52/650.3
2004/0255551 A1 * 12/2004 Fuhr ..... 52/782.1
2005/0069380 A1 * 3/2005 Shelton ..... 403/230
2007/0199277 A1 * 8/2007 Martin ..... 52/750

* cited by examiner

*Primary Examiner*—Robert J Canfield
*Assistant Examiner*—Matthew J Gitlin
(74) *Attorney, Agent, or Firm*—Barbara J. Luther

(57) ABSTRACT

A deck is disclosed that is level with the top of a concrete/plaster pool having a decorative ribbon of tile along the top of the pool side and an apron surrounding the pool having at least a partially flat surface. The deck has a surface of deck surface members having lengths and ends, the lengths being sized to the dimensions of the pool and the surface being at the same level as the pool apron. Under the deck are supports of joists which are mostly perpendicular to the decking surface members, of underlying beams that form a sturdy base for the joists and beam hangers being secured to the sides of the pool below the decorative ribbon along the top of the pool side and being anchored into the concrete side of the pool. Also disclosed is an improved method for installing such a deck.

7 Claims, 10 Drawing Sheets

SEMI-PERMANENT, IN-POOL SURFACE CONSTRUCTION

TECHNICAL FIELD

Embodiments of the invention relate generally to decks and their construction methods. More particularly, the embodiments of the invention relate to a pool-covering deck apparatus and method of construction.

BACKGROUND

In the warmer climates, many homes are equipped with outdoor in-ground pools formed from shot-crete, (blown-in concrete) which is covered with a smooth water proof plaster. Such pools are often free form, such as the classic kidney shape, rather than the rectangular form preferred for exercise and competition. These swimming pools are usually surrounded by concrete decks which are level with the edge of the pools. In addition, many pools are equipped with a decorative ribbon of tile around the inside upper edge of the pool for easier cleaning, for a decorative effect, and because the tile does not deteriorate in the open hot air, whereas the plaster does.

Homeowners change their minds about the desire for a pool. Sometimes the children who used the pool have grown and no longer reside in the home. Other times, grandchildren appear on the scene and need to be protected from a swimming pool. New homeowners may purchase the home for its indoor characteristics and do not want the outdoor pool. The responsibility for the pool (problems of others gaining access and harming themselves) may weigh heavily on the homeowner.

Pool maintenance and upkeep include electricity to circulate the water and cleaning devices, chemicals to kill algae and maintain the proper salt balance and pH, water replacement, pool cleaning components such as hoses, pool maintenance charges by contractors, insurance arid pool replastering. Current estimates for pool maintenance and upkeep are estimated at about $2,000 per year. Closing off an unwanted pool can save the homeowner significant funds over a few years.

There are few alternatives for getting rid of the pool. For instance, pools can be filled in, often with the concrete deck that surrounded the pool, fill dirt, and then landscaped over. If the pool is filled in, it becomes difficult to be used again because it is extremely difficult to dig out the demolished concrete; replacing the pool is prohibitively expensive. A new pool often most be relocated to a less convenient part of the home's yard.

What is needed is a structure that can be individualized into the landscape plan without seriously damaging the swimming pool, which would permit the pool to he "revived" at a later date. Ideally such a structure would be added to completely cover the pool, preventing anyone, even small animals, front entering the pool. Preferably the structure would be attached to the pool so as to avoid damaging the expensive decorative tile ribbon around the top edge of the pool. Moreover, because concrete in-ground pools are built in a myriad of shapes and the structure covering the pool needs to be in a unique shape, there needs to be an efficient way to cut the wood deck planks to their proper size(s) and close tolerance with tire pool dimensions.

SUMMARY OF INVENTION

In one embodiment there is provided a deck that is level with the top of a concrete-sided pool having a decorative ribbon along the top of the pool side and a pool apron surrounding the pool having at least partially flat surface. The deck has a surface of decking surface members having lengths and ends, the lengths being sized to the dimensions of the pool and the surface being at the same level as the pool apron. Beneath the surface layer are support layers, including floor joists which are mostly perpendicular to the lengths of the decking surface members and underlying beams that form a sturdy base for the floor joists. The beams are supported by beam hangers secured to the sides of the pool below the decorative ribbon along the top of the pool side and being mechanically connected into the concrete side of the pool.

In another embodiment, there is provided a method of constructing an in-pool deck for use in covering concrete-sided pools. This method has the steps of a. affixing a plurality of beam hangers to the concrete side of the pool such that the bottom surface of the beam hanger is displaced a sufficient distance from the top of the pool surface to accommodate the height of the surface members, the floor joists, and the beam to be installed in the beam hanger; b. placing in each of the plurality of beam hangers at least one block and a beam, the block being used to position the deck structure above the pool surface; c. placing a plurality of floor joists at cross angles to the beams and affixing the floor joists to the beams; d. placing a plurality of deck surface members at cross angles to the beams and affixing the deck surface members to the floor joists to form a deck structure; e. drawing a saw along the deck surface members to cut off the excess lengths of the deck surface members and provide a deck surface which corresponds to the contour of the pool; f. placing a jack under the deck structure; g. raising the deck structure with the jack to permit the removal of at least one block in the beam hanger; and h. lowering the deck structure to permit the beams to rest in the beam hangers, thereby permitting the surface of the deck structure to become level with the top of the pool.

In another embodiment of the method, there is provided a step of arranging the floor joists at mostly right angles to the beams.

In another embodiment of the method, the step of placing a jack is performed after placing the beams, the floor joists or the deck surface members. Optionally, the method has the step of removing the jack. Optionally, the method has the step of placing a pump in the bottom of the pool. Optionally, the method has the step of creating an access door in the deck structure.

In the following detailed description of the preferred embodiments, reference is made to the accompanying drawings that form a part hereof, and in which are shown by way of illustrating specific embodiments in which the invention may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of present inventions. The following detailed description, therefore, is not to be taken in a limiting sense, and the scope of various embodiments of the invention is defined only by the appended claims, along with the full range of equivalents to which such claims are entitled.

DETAILED DESCRIPTION OF INVENTION

The current invention incorporates unique features which offer important benefits appreciated by the owner of a pool. First of all, the deck is installed in a new configuration, such that the deck contact with the side of the pool is below the decorative tile rim around the pool. This gives the pool deck a semi-permanence, such that the structure can be removed at a later date, and the pool be returned to working status with a minimum of repair and cost. A pool is typically only replastered to the tile line. To replaster a pool the old plaster needs to be mostly chipped out with jack hammers, so none of the deck mounts are a detriment to the pool structure or repairs. All components used in the concrete walls can be replastered over without the problems of showing through or impeding the replaster process. Thus, replastering can be performed quickly. Were the deck structure installed in the usual manner (higher on the pool wall), the decorative tile rim would be damaged, requiring expensive replacement and delays in returning the pool to service. The decorative tile is saved from damage and not destroyed by drilling and mounting the beam hanger brackets around the upper perimeter of the pool. Instead, it is mounted just below the tile line to protect the tile from damage.

The structures described below can be assembled and installed for a modest investment, having a payback time of less than four years (taking into account the pool maintenance costs mentioned above).

The embodiments described below are built to normal building standards for floors and decks and usually far exceed structural requirements. In fact, most exceed commercial requirements for floor loading. If one desires to put even heavier loads on the deck, the deck can be easily reinforced for increased loads.

Figure 1:
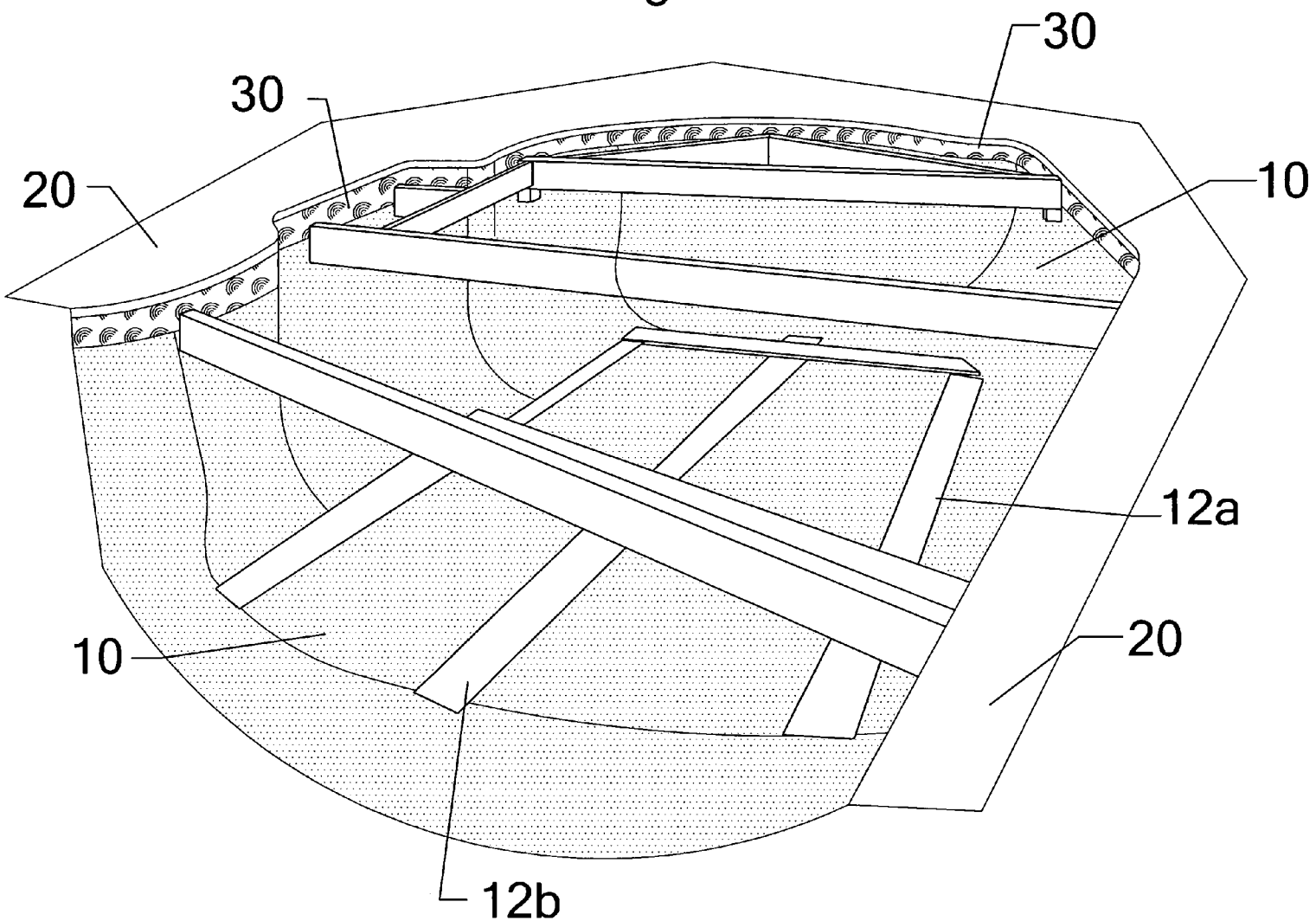
FIG. 1 is a perspective view of a deck being built to cover a swimming pool. Note that boards have been placed in the bottom of the pool for moving across the bottom of pool.

FIG. 1 shows an empty pool 10 in which several boards 12*a*, 12*b*, etc., or scaffolding, have been placed for workers to walk during construction. The scaffolding 12*a* and 12*b* are removed from the pool upon completion of the deck; alternately boards may be left in place to support stored items off the pool surface. Another advantage of the embodiments described below is that there is accessible space under the deck cover for storage of water-proof objects, such as kayaks, old pool equipment, plastic storage boxes, etc.

Figure 2:
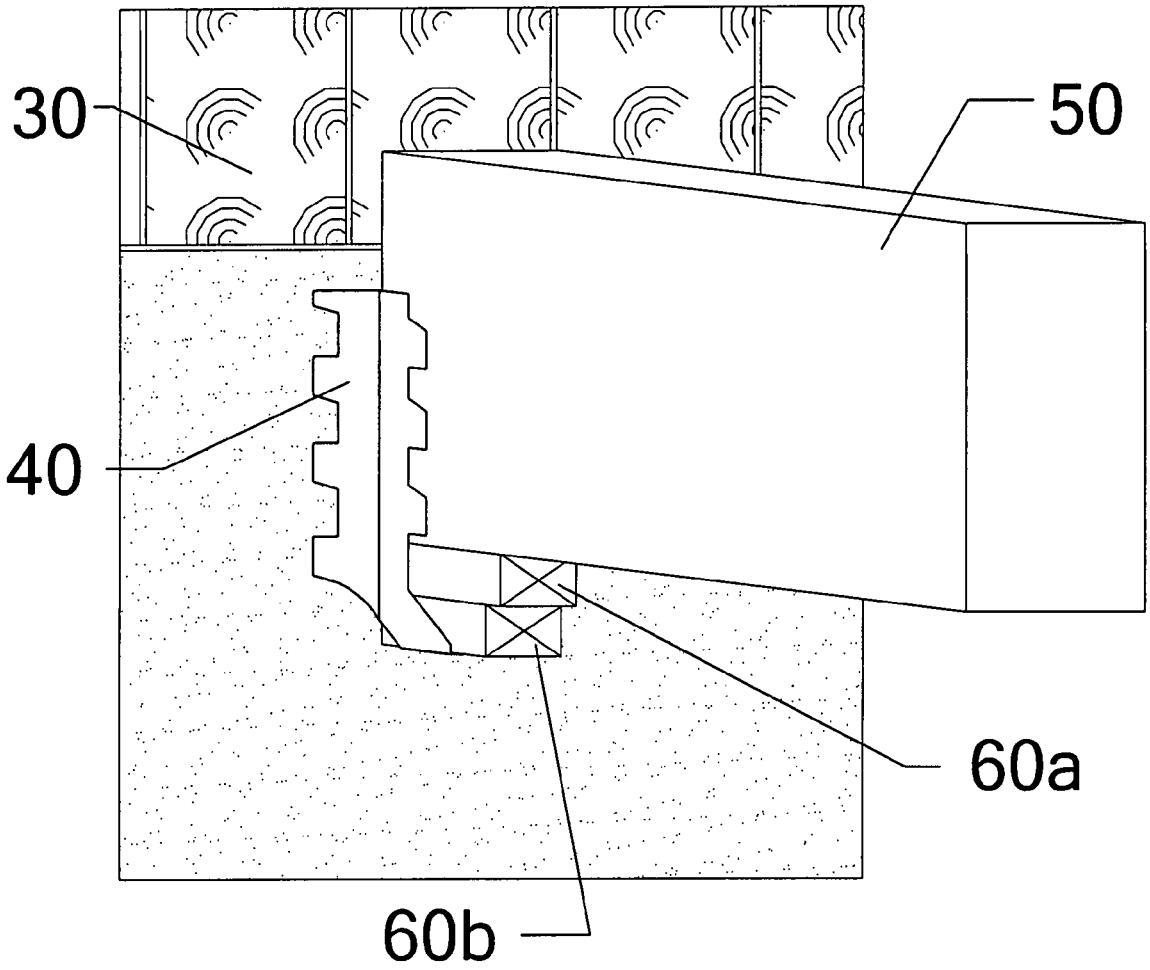
FIG. 2 is a perspective view of a swimming pool wall on which a beam hanger has been installed below the decorative stripe around the pool. The beam hanger contains a beam and blocks to shim the beam.
Figure 3:
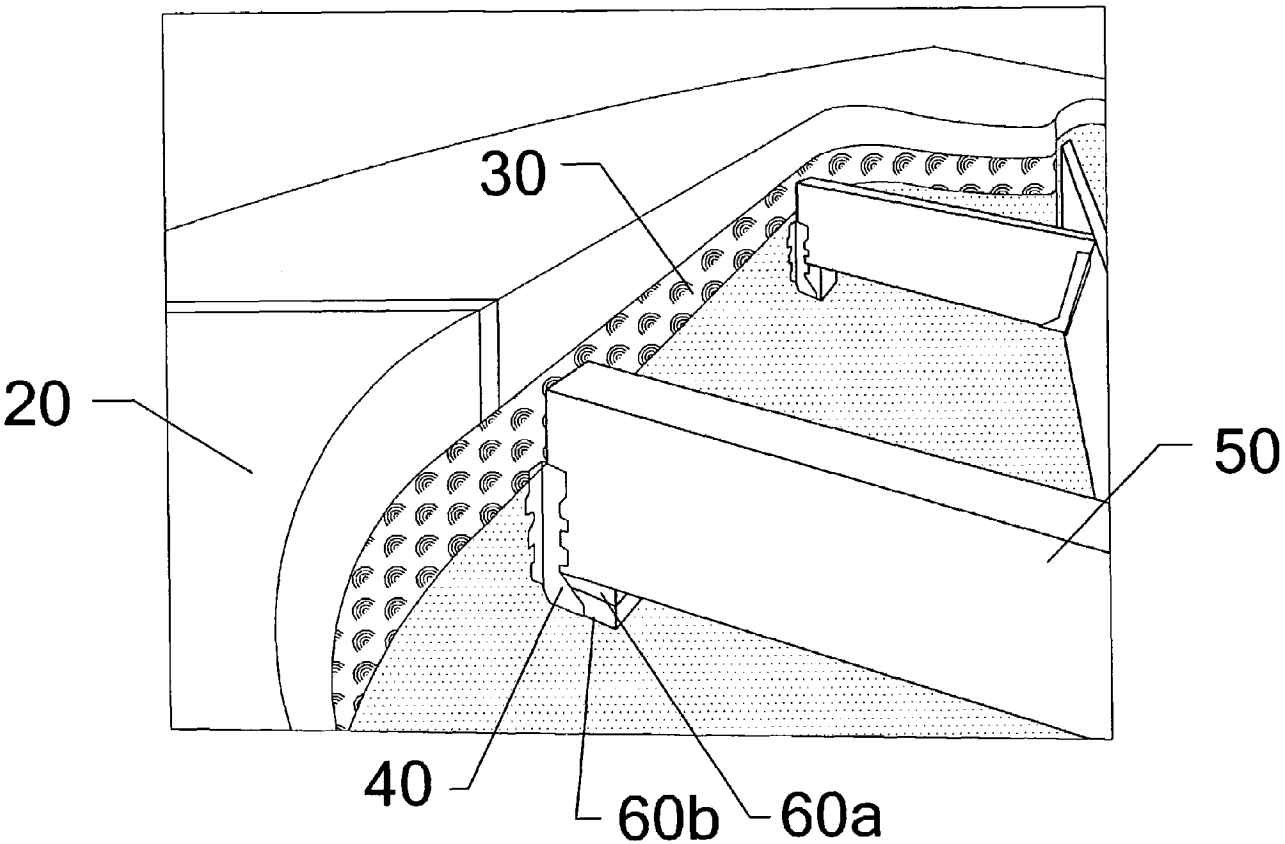
FIG. 3 is another perspective view of a swimming pool wall with decorative tile around its edge and beam hanger installed below the decorative tile and beams being installed

FIGS. 2 and 3 show the locations of anchors and beam hangers 40 being placed into the pool side. Note that the beam hanger 40 location is below the decorative tile rim 30, or at least it is not fastened into the tile of the pool. The beams 50 are placed in these beam hangers 40 and form the base for the pool structure. The beams 50 are shimmed up with blocks 60*a*, 60*b*, to raise the deck structure above the concrete apron 20. The blocks 60*a*, 60*b*, etc, are removed when deck structure (see below) is completed and lowered to concrete apron 20 level.

Figure 4:
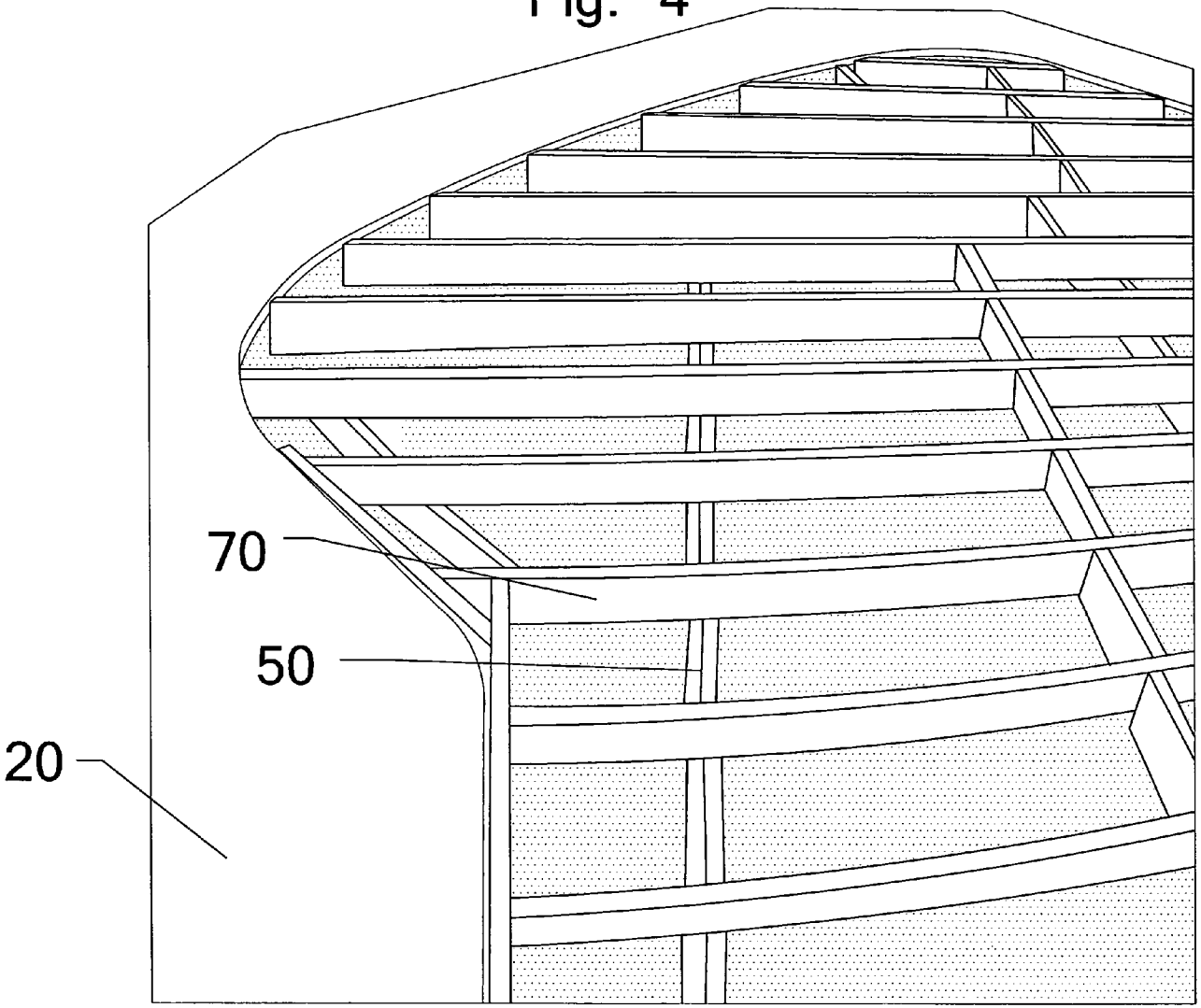
FIG. 4 is a perspective view of the deck being built to cover the swimming pool. In this view, floor joists have been added.

FIG. 4 shows the beams 50 in place. Their locations are selected based on the lengths of the floor joists 70 they bear. The horizontal beam 50 placement and distances between adjacent beams 50 are determined by well known calculations used in conventional floor and deck design. FIG. 4 also shows some of the floor joists 70 in place in the emerging deck structure. These floor joists 70 extend across the pool. Their depth is chosen based on conventional deck design in consideration of the weight of deck surface members 80 (discussed below) and other weight they are intended to support. To accommodate greater weights, the beams may be taller or closer together and the floor joists also can be taller or closer together, and other vertical support from the bottom up to the beams may be added. The floor joists 70 are placed over the beams 50 at mostly perpendicular angle(s) to the beams. Mostly perpendicular angles range from approximately 60-120°, preferably 75-105°, and most preferably 80-100°; of course, the joists 70 can be installed at perpendicular angles to the beams 50.

Figure 5:
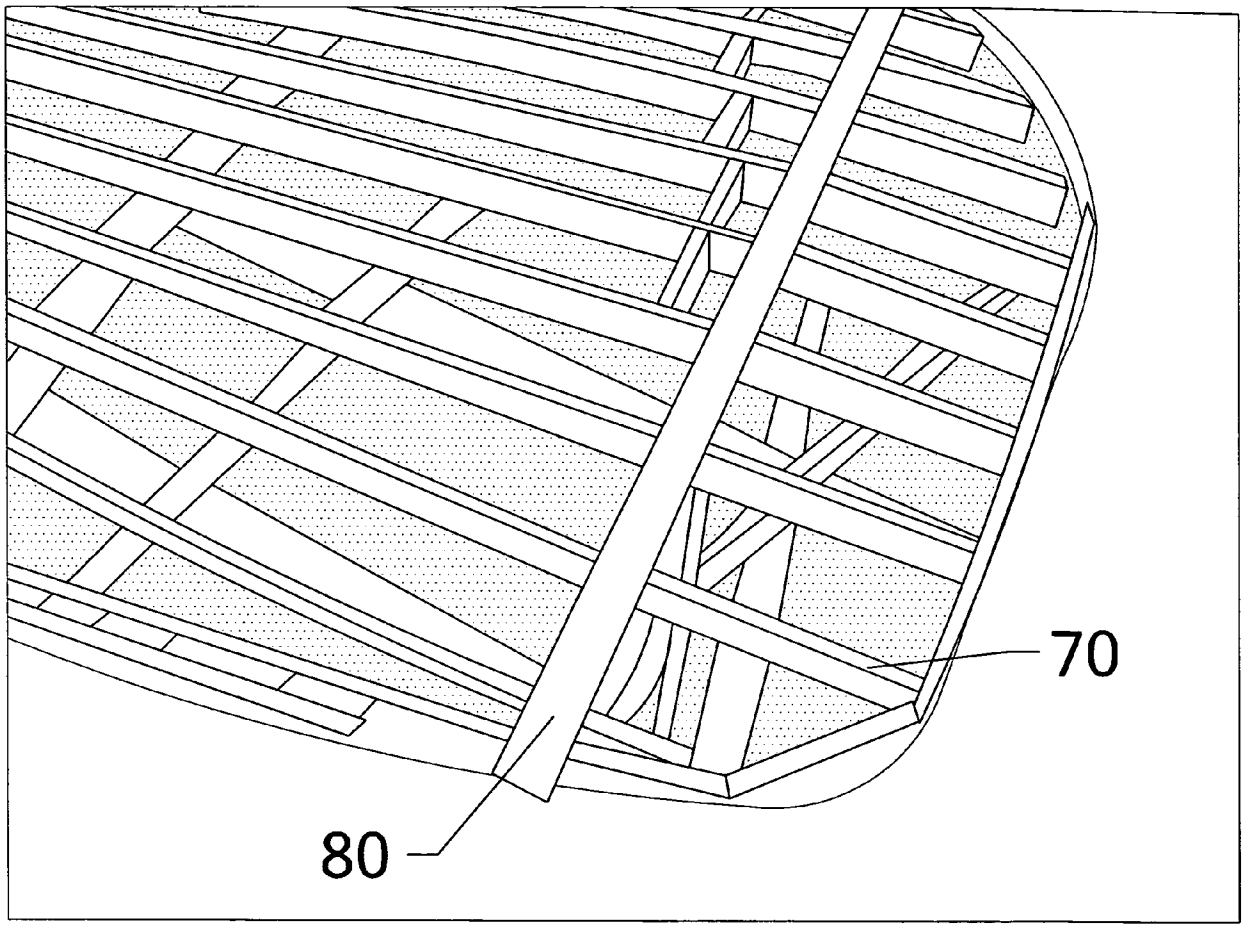
FIG. 5 is a perspective view showing the start of the deck surface with the placement of a deck surface member.
Figure 6:
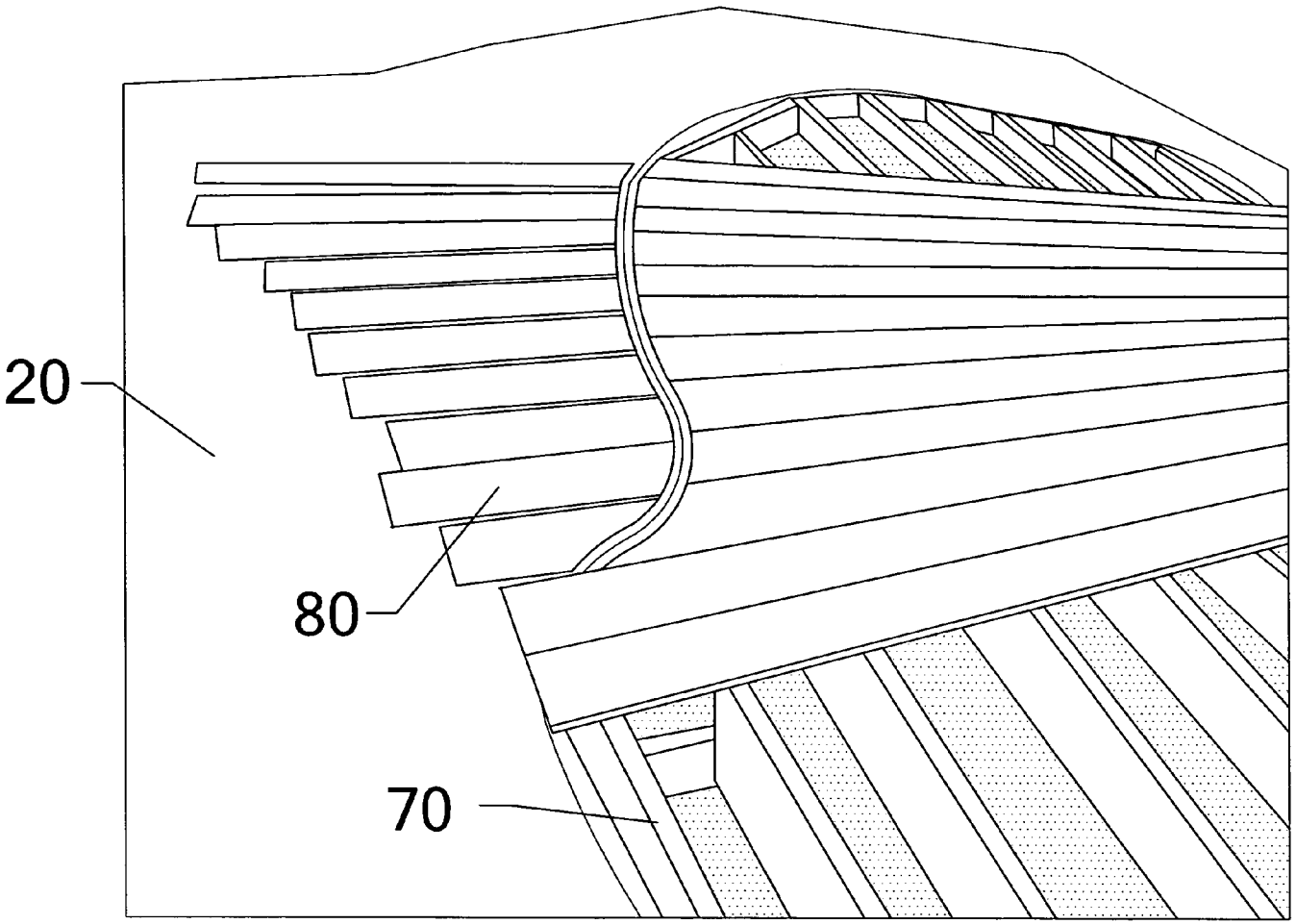
FIG. 6 is a perspective view of a partially built deck surface from which the excess lengths of board have been trimmed to fit into the free-form outline of the swimming pool.

FIG. 5 shows a deck surface member 80 placed on the floor joists 70 to which it will be affixed with nails, screws or other such fasteners. FIG. 6 shows numerous deck surface members 80 on the floor joists 70. In this embodiment, the deck surface members 80 are initially positioned above the concrete apron 20. At this height, it is easier to cut deck members 80 to accommodate the pool's outline. The deck surface member 80 is placed over the joists 70 at mostly perpendicular angle(s) to the joists 70. Mostly perpendicular angles range from approximately 60-120°, preferably 75-105°, and most preferably 80-100°; of course, the deck surface member 80 can be installed at perpendicular angles to the joists 70. In this embodiment, the deck surface member 80 is a plank.

FIG. 6 shows a partially built deck surface from which the excess lengths of deck surface members 80 have been trimmed.

Figure 7:
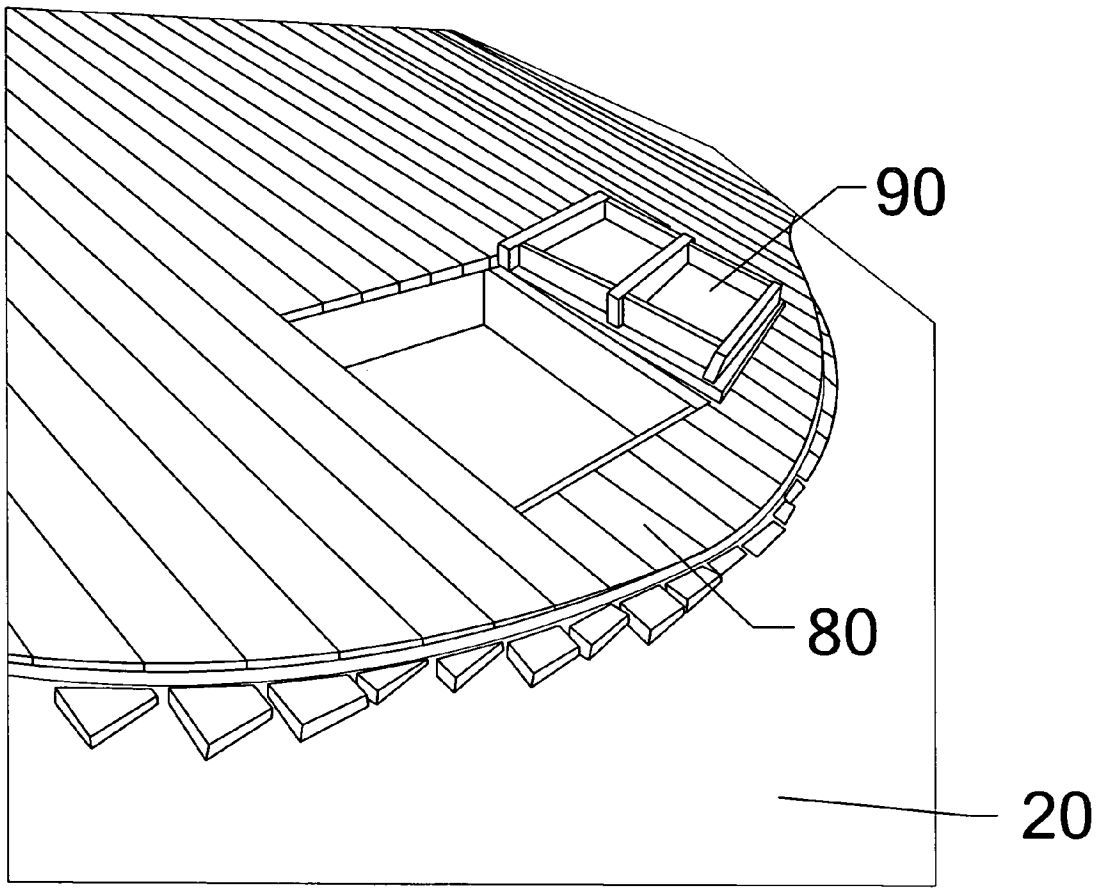
FIG. 7 is a perspective view of the deck surface with access door. The excess board lengths have been trimmed from the deck surface.

FIG. 7 shows an access door 90 to the area underneath the pool deck. This enables access to the under-deck area for performing final steps of construction and allows access to maintenance of motor pump (not shown) that is required to keep pool empty of water. The access door also allows entry of items to be stored, such as pool mechanicals, other outdoor equipment or water proof containers.

Figure 8:
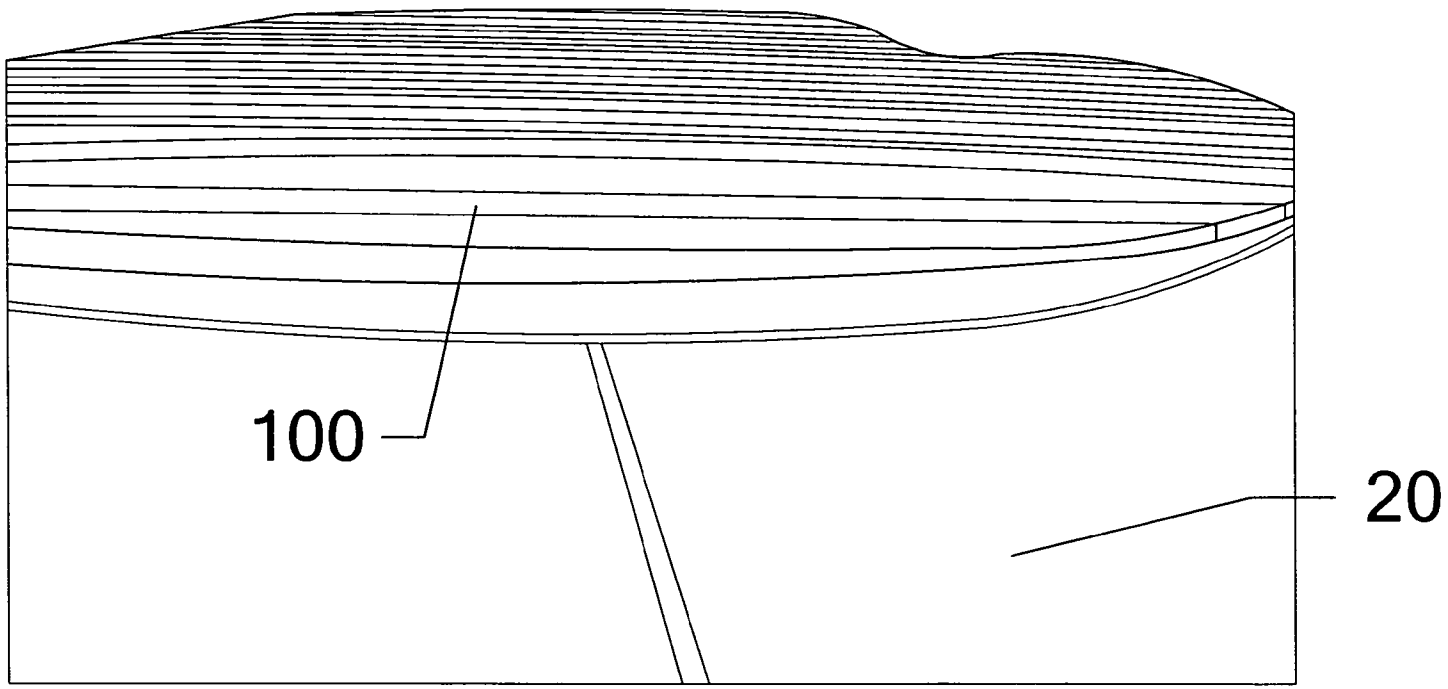
FIG. 8 is an end view of the completed deck surface before it is lowered to the level of the concrete apron around the swimming pool.

FIG. 8 is a side view of a completed deck 100, which is raised above concrete apron 20. In this embodiment, with the deck surface raised above the surrounding pool deck, the ends of the deck surface members 80 are sawed off in a continuous motion around. Such a cutting method permits the carpenter to blend the edges of adjacent members.

Figure 9:
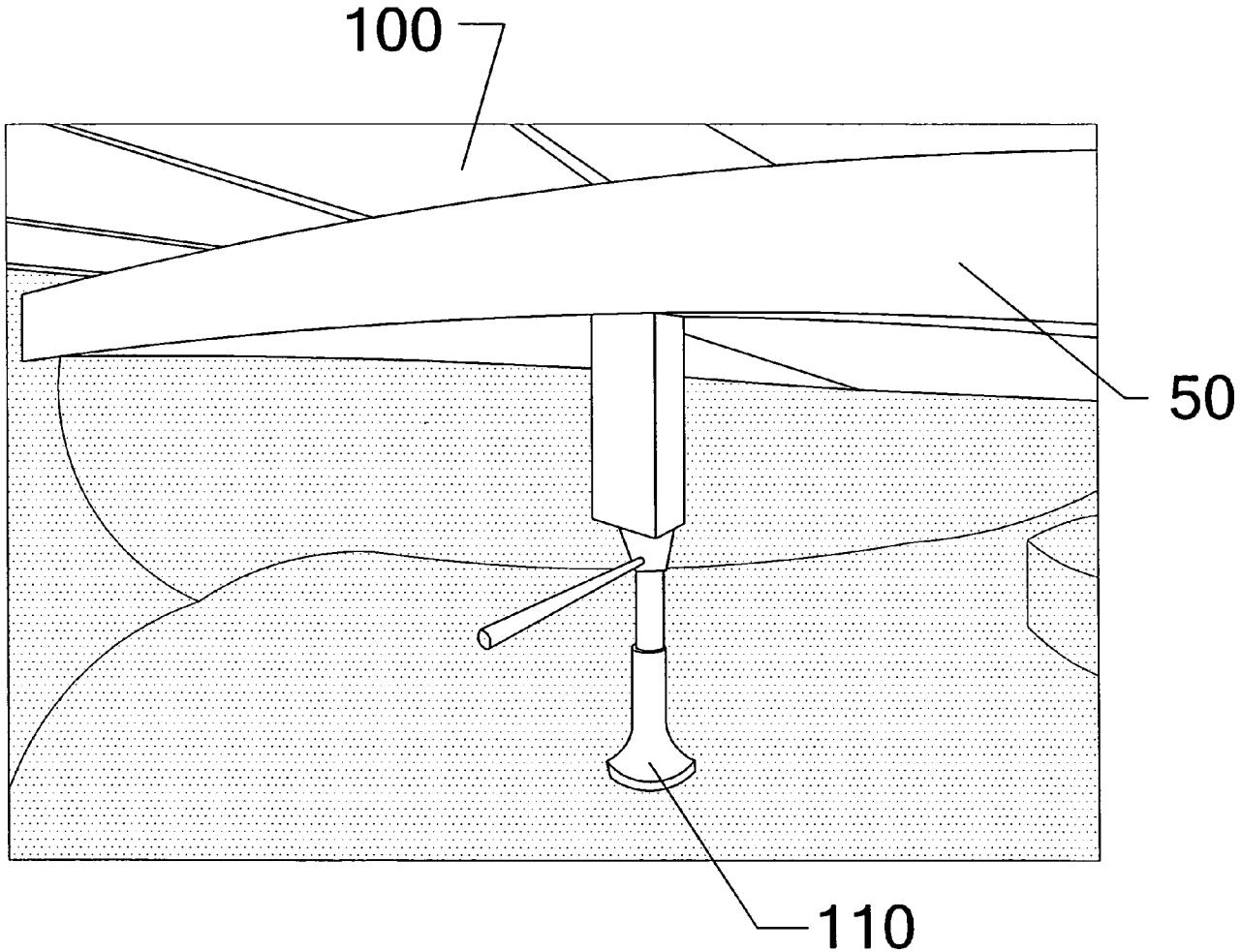
FIG. 9 is a perspective view below the deck structure, showing a jack that is used to raise the deck structure sufficiently to remove the blocks under the beams. The blocks raised up the deck structure for rapid cutting of the deck surface members.

FIG. 9 provides a view under the deck structure 100 accessed through door 90. A jack 110 has been placed to raise deck structure 100 a few inches to take pressure off the beams

50 and allow removal of blocks 60*a*, 60*b*, shown in FIG. 2. Jack 110 then is used to lower the deck structure 100 level to that of the concrete apron 20.

Figure 10:
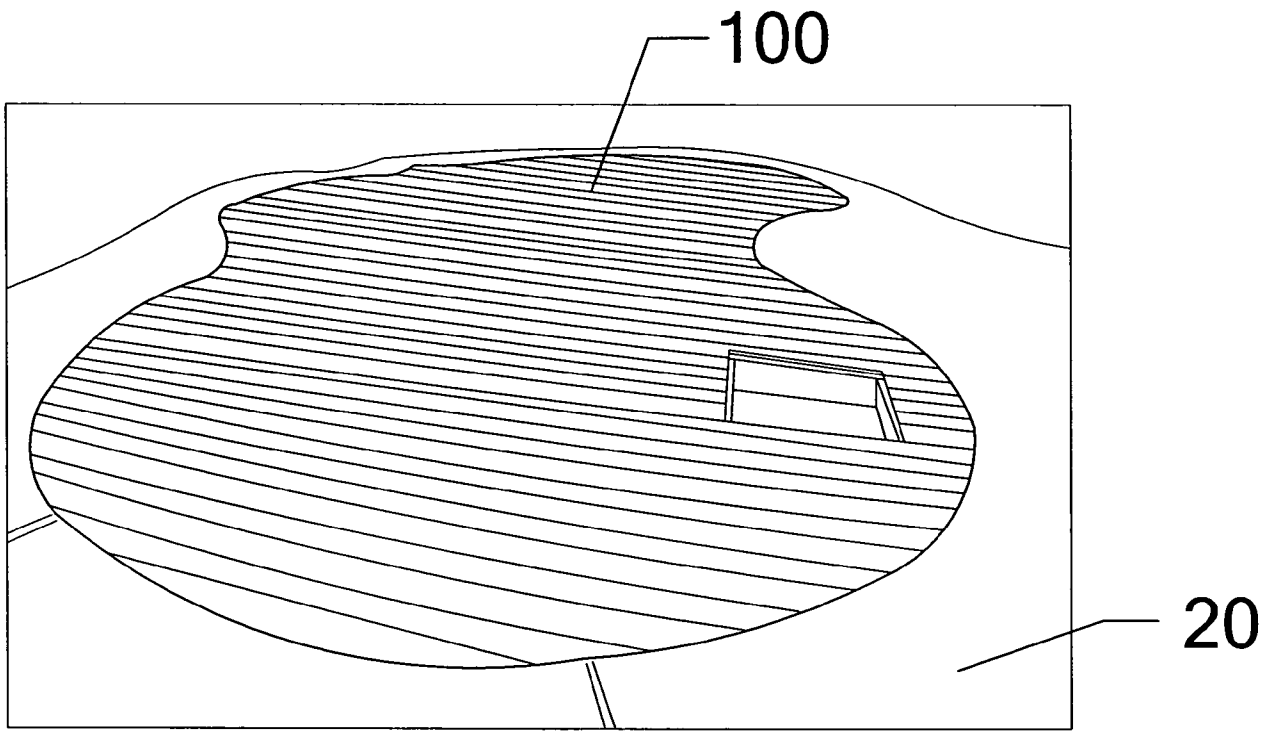
FIG. 10 is a perspective view of the finished deck structure with its deck surface flush with the surface of the pool apron. The access door is shown open to permit entry to below-deck where maintenance may be done on the pump.

FIG. 10 shows a completed deck surface 100 flush with the surrounding concrete apron 20. Also shown are the access door 90 and a pump 120. Through the access door 90, the pump 120 is lowered and placed at the lowest point of the pool to pump out water from rain or other sources.

EXAMPLE 2

In this embodiment, a deck structure 100 is constructed as described above, including installing the beam hangers 40 below the decorative tile rim 30 of the pool. However, in this embodiment the beams 50 are placed directly into the hangers without the use of shimming blocks 60. The rest of the beams 50 are so installed. The floor joists 70 are installed the same. However, each deck surface member 80 is individually placed after it has been sized and sawed to the precise length needed at its location on the deck.

When deck members were individually sized and then attached to the deck, these steps took approximately 3 days for a free-form pool measuring at the maximums 20 feet by 40 feet. When the new pool construction method (using shims and jacks to raise the structure) was invented and used, the construction time decreased to a little over one day. Not only was the time savings huge, but the overall appearance of the deck edge improved. Because the sizing of all the deck members was performed in a smooth, continuous motion, the adjacent deck members had more consistent and attractive blending of edge lines.

Decks are made from treated lumber, composite material. Aluminum, Western red cedar, teak, mahogany, and other hardwoods and recycled planks made from high-density polyethylene (HDPE), polystyrene (PS) and PET plastic as well as mixed plastics and wood fiber (often called "composite" lumber).

A variety of braces, brackets and hangers can be used to support and form the deck structure. For example, the bracket that is anchored to the pool wall can be a conventional beam hanger or other conventional bracket used in the industry.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R § 1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Description of Embodiments of the Invention, with each claim standing on its own as a separate preferred embodiment.

The invention claimed is:

1. A method of constructing an in-pool deck structure to cover concrete-sided pools having an uppermost edge, the method comprising the steps of a. affixing a plurality of beam hangers to the concrete side of the pool such that a bottom surface of each beam hanger is displaced a sufficient distance below the uppermost edge to accommodate the height of surface members, joists, and beams to be installed in the beam hanger;

b. placing in each of the plurality of beam hangers at least one block and a beam, the block having sufficient height to position the deck structure above the uppermost edge;

c. placing a plurality of joists at mostly perpendicular angles to the beams and affixing the joists to the beams;

d. placing a plurality of deck surface members at mostly perpendicular angles to the beams and affixing the deck surface members to the joists to form a deck structure;

e. drawing a saw along the deck surface members to cut off the excess lengths of the deck surface members and provide a deck surface which corresponds to the dimensions of the pool;

f. placing a jack under the deck structure;

g. raising the deck structure with the jack to permit the removal of at least one block in the beam hanger; and h. lowering the deck structure to permit the beams to rest in the beam hangers thereby permitting the surface of the deck structure to become level with the uppermost edge of the pool.

2. The method of claim 1, comprising arranging the joists at angles to the beams ranging from 80-100°.

3. The method of claim 1, comprising arranging the deck surface members at angles to joists ranging from 80-100°.

4. The method of claim 1, wherein the step of placing a jack is performed after placing the beams, the joists or the deck surface members.

5. The method of claim 1 further comprising the step of removing the jack.

6. The method of claim 1, further comprising the step of creating an access door in the deck structure.

7. The method of claim 1, further comprising the step of placing a pump in the bottom of the pool.

* * * * *